US008427057B2

(12) United States Patent
Durand et al.

(10) Patent No.: US 8,427,057 B2
(45) Date of Patent: Apr. 23, 2013

(54) MICROWAVE FREQUENCY STRUCTURE FOR MICROWAVE TUBE WITH BEAM-CONTAINING DEVICE WITH PERMANENT MAGNETS AND ENHANCED COOLING

(75) Inventors: Alain Durand, La Garenne Colombes (FR); Alain Le Clair, Velizy-Villacoublay (FR)

(73) Assignee: Thales, Neuilly-sur-Seine (FR)

( * ) Notice: Subject to any disclaimer, the term of this patent is extended or adjusted under 35 U.S.C. 154(b) by 452 days.

(21) Appl. No.: 12/747,946

(22) PCT Filed: Dec. 10, 2008

(86) PCT No.: PCT/EP2008/067236

§ 371 (c)(1),
(2), (4) Date: Sep. 7, 2010

(87) PCT Pub. No.: WO2009/077407

PCT Pub. Date: Jun. 25, 2009

(65) Prior Publication Data

US 2010/0327743 A1 Dec. 30, 2010

(30) Foreign Application Priority Data

Dec. 14, 2007 (FR) ..... 07 08741

(51) Int. Cl.
*H01J 25/34* (2006.01)

(52) U.S. Cl.
USPC ..... 315/3.5

(58) Field of Classification Search ..... 315/3.5, 315/5.13, 5.35, 111.41, 111.51, 111.81, 500, 315/501, 505, 506; 313/153, 154
See application file for complete search history.

(56) References Cited

U.S. PATENT DOCUMENTS

| | | | | |
|---|---|---|---|---|
| 3,129,356 | A | 4/1964 | Phillips | |
| 3,373,388 | A | 3/1968 | Meyerer | |
| 4,433,270 | A | 2/1984 | Drozdov | |
| 4,720,692 | A | 1/1988 | Jin | |
| 5,576,679 | A * | 11/1996 | Ohashi et al. | 335/306 |
| 5,886,473 | A * | 3/1999 | Watanabe et al. | 315/111.21 |
| 6,768,265 | B1 * | 7/2004 | Ives et al. | 315/5.16 |
| 7,116,051 | B2 * | 10/2006 | Vancil et al. | 315/5 |

FOREIGN PATENT DOCUMENTS

EP 0591579 A1 4/1994

OTHER PUBLICATIONS

Wessel-Berg, T., "A new quadrupole PPM focusing scheme for high density electron beams," Electron Devices Meeting, Dec. 5, 1993. IEDM '93. Technical Digest., Washington, DC, ISBN 978-0-7803-1450-4, pp. 153-156.

* cited by examiner

*Primary Examiner* — Minh D A
(74) *Attorney, Agent, or Firm* — Baker Hostetler LLP

(57) ABSTRACT

The invention relates to a microwave frequency structure for microwave tube comprising a cylindrical vacuum jacket and a device for containing an electron beam in the axis of revolution of the cylindrical jacket. The containing device comprises at least two rows, each containing permanent magnets, each row being aligned either side of and equidistant to the beam-containment axis, the at least two rows containing permanent magnets being of parallelepipedal shapes and having a magnetic polarization parallel to one of its edges in a plane transversal to the axis, their direction of magnetization in the row changing alternately from one containing magnet to another next containing magnet, or preceding containing magnet, to create an alternating periodic magnetic field along the containment axis.

19 Claims, 10 Drawing Sheets

MICROWAVE FREQUENCY STRUCTURE FOR MICROWAVE TUBE WITH BEAM-CONTAINING DEVICE WITH PERMANENT MAGNETS AND ENHANCED COOLING

CROSS-REFERENCE TO RELATED APPLICATIONS

This application is a National Stage of International patent application PCT/EP2008/067236, filed on Dec. 10, 2008, which claims priority to foreign French patent application No. FR 07 08741, filed on Dec. 14, 2007, the disclosures of which are hereby incorporated by reference in their entirety.

FIELD OF THE INVENTION

The invention relates to a microwave frequency structure for microwave tube comprising a containing device with permanent magnets for an electron beam from the tube with a configuration that allows enhanced cooling of said structure.

BACKGROUND OF THE INVENTION

A microwave frequency tube comprises a microwave frequency structure that is passed through by an electron beam generated by an electron gun. The electron beam is contained in a space where the interaction occurs between the electrons of the beam and an electromagnetic wave (traveling or standing), the field configuration of which wave is determined by the microwave frequency structure of the tube: resonant cavities in the case of the klystron and a delay line in the case of a traveling wave tube (TWT).

In most microwave frequency electronic tubes, a magnetic field is used to contain the beam in the interaction space for interaction with the microwave frequency wave. The tubes that are most widely used, like traveling wave tubes (TWT) and klystrons, use an electron beam of cylindrical geometry, which requires a magnetic field parallel to the axis of the electron beam.

The beam-containing magnetic field can be generated by a solenoid, or using permanent magnets around the microwave frequency structure of the tube. The use of permanent magnets eliminates the need for an electrical power supply for the solenoid, but requires a large-volume (and therefore very heavy) permanent magnet to generate a magnetic field with a single alternation in the interaction space. The term "alternation" should be understood to mean a determined direction of the beam-containing magnetic field.

To reduce the volume and the weight of the permanent magnet, an alternating magnetic field is used, generated by a series of permanent magnets, along the containment axis of the beam. The magnets provide alternate fields of opposite directions from one magnet to the next in the microwave frequency structure of the tube; the expression "periodic permanent magnet focusing", with the acronym PPM, then applies.

This type of containment of the electron beam by alternating magnetic field is commonly used in traveling wave tubes (TWT) and in some klystrons. Since klystrons are tubes that are shorter than TWTs, the containment field comprises fewer alternations (single reversal permanent magnet: for two alternations; double reversal permanent magnet: for three alternations).

FIG. 1 shows a partial cross-sectional view of a microwave frequency structure of a helix TWT of the prior art.

The microwave frequency structure of FIG. 1, of circular cylindrical shape on an axis ZZ' of propagation of a cylindrical electron beam 10, comprises a sheath 14 with incorporated polar shoes containing the helix 16 of the TWT. The sheath 14 is used both to mechanically secure the helix 16 in the microwave frequency structure via insulating supports 18, and to seal the tube.

The sheath 14 comprises an assembly of a series of pole pieces (or parts) 20 made of iron and non-magnetic spacers 22, a spacer separating two consecutive pole pieces forming spaces 24 incorporating toroid-shaped permanent magnets 30 generating the magnetic field for containing the electron beam on the propagation axis ZZ'.

The toroid-shaped magnets 30, with axes of revolution colinear to the axis ZZ', and with rectangular sections, are magnetized parallel to the axis ZZ'. The direction of magnetization changes alternately from one magnet to another next or preceding magnet along the axis ZZ', which produces a sinusoidal variation of the containing magnetic field generated by the magnets 30 along the axis ZZ'.

FIG. 2 shows a partial cross-sectional view of a section of the sheath 14 of the structure of FIG. 1.

The cross-sectional view of FIG. 2, along a plane of symmetry Ps passing through the axis ZZ', shows the path of the magnetic flux lines Ch from the magnet 30 over a length corresponding to an alternation of the magnetic field (or half a period corresponding to two consecutive changes, on the axis ZZ', of the direction of the magnetic field). The pole pieces 20 guide the magnetic flux generated by the permanent magnets to obtain a beam-containing magnetic field parallel to the axis ZZ'.

FIG. 3 shows a partial cross-sectional view of a microwave frequency structure of a coupled-cavity TWT 40.

As in the cases of the TWT of FIG. 1, polar shoes 42 guide the magnetic flux produced by the permanent magnets toward the axis ZZ', which makes it possible to obtain a magnetic field parallel to the axis ZZ', but, unlike the helix TWT of FIG. 1, the polar shoes have a second function: they form the walls of the successive cavities 40 forming the delay line of the tube.

The toroid-shaped permanent magnets 44 similar to those used in the helix TWTs are placed around the cavities 40; because of this, they have a larger diameter than those used on helix TWTs. On this type of coupled-cavity tube, the variation of the magnetic field, along the containment axis ZZ', is not sinusoidal. In practice, one alternation contains two magnetic field peaks instead of one. The term concentrator with harmonic 3 then applies. This result is obtained by placing a magnetic core 46 or a polar shoe mid-way between the two polar shoes 42 which guide the magnetic flux either side of the permanent magnet 44. This type of concentrator is also suitable for klystrons comprising several single or multiple cavities (extended-interaction klystrons).

These devices for containing the beam in the microwave frequency structure of the TWTs, helix or coupled-cavity, have drawbacks.

For example, when a TWT is operating, a portion of the microwave frequency power propagated in the microwave frequency structure of the tube is lost in the form of heat. These losses take place on the helix or in the walls of the cavities depending on the TWT type (losses through skin effect) or in the helix-supporting dielectrics, in the lossy dielectrics used for matching (severe loads) or for absorbing parasitic modes (resonant buttons).

Moreover, a portion of the electrons from the beam is intercepted by the helix of the TWT or by the drift tubes between the cavities of a coupled-cavity TWT or a klystron.

Thus, when an electron from the beam falls on the delay line formed by the helix of a TWT or on a klystron drift tube, its kinetic energy is converted into heat.

These two mechanisms, microwave frequency losses and electron beam interception, create a power flux at the core of the microwave frequency structure, which determines a maximum operating temperature of the structure according to the temperature of the cooling source surrounding the microwave frequency structure and of the thermal impedance between a central portion of the structure and the cooling source.

In the case of the helix TWT with microwave frequency structure represented in FIG. 1, the power dissipated as heat passes through the helix 16 toward a cold source outside the tube via the dielectric supports 18, the polar shoes 20, cooling fins of the tube then the tube cladding parts (not represented in FIG. 1).

In the case of a coupled-cavity TWT or the klystron, the dissipated thermal power passes through the drift tubes toward the cold source via the polar shoes, fins then the tube cladding parts.

In addition to the production of the magnetic field for containing the electron beam, the beam containing system of the microwave frequency tubes of the prior art is therefore used to cool the tube, which has drawbacks. In practice, the thermal conductivity of the iron of the polar masses is not as good as that of copper (80 W/m.K for iron and 398 W/m.K for copper). In both cases, the weak point of these structures is the cooling.

One solution for enhancing the cooling and increasing the average power delivered by a microwave frequency tube of the prior art consists in producing cooling channels between the hot internal portion of the microwave frequency structure and the permanent magnets. For example, on a coupled-cavity TWT (FIG. 3), the internal and external diameters of the magnets 44 can be increased to place the cooling channels between the outer diameter of the cavities 40 and the magnets.

However, this cooling solution is reflected in an increase in the volume and the weight of the microwave frequency structure and notably of the electron beam-containing device, which is not always compatible with the application considered.

Another solution for enhancing the cooling without excessively modifying the volume and the weight of the microwave frequency structure involves placing a thermal shunt between the central portion of the microwave frequency structure and the cold source to reduce the thermal impedance. To this end, the iron of the polar shoes can be replaced by copper and it is then more advantageous to use permanent magnets with a magnetic polarization in a plane perpendicular to the axis ZZ' of the beam rather than parallel to the axis of the beam, since there are no longer any polar shoes to channel the flux lines toward the axis ZZ'. It is also possible to remove a portion of the volume of the magnet and replace it with copper to produce the thermal shunt.

FIG. 4*a* shows a partial view of the sheath 14 showing the field lines of the permanent magnet 30 of FIG. 2. The toroid-shaped magnet 30 between two polar shoes 20, magnetized parallel to the axis ZZ' according to the arrow Fc (designated "axial magnetization") is a conventional structure of the prior art.

FIG. 4*b* shows a partial view of another structure comprising two toroid-shaped permanent magnets A1, A2 magnetized along axes perpendicular to the axis ZZ' (arrows Fc1, Fc2 in the figure) (designated "radial magnetization") according to the solution involving replacing the polar shoes with copper.

FIGS. 4*a* and 4*b* show the plots of the flux lines Ch over a distance corresponding to a half-period following the axis ZZ'.

FIGS. 4*a* and 4*b* show that, for magnetized toroidal cores (or rings) with the same internal r and external R radii, the flux lines Ch are less close to the axis ZZ' in the structure without polar shoes of FIG. 4*b* than in the conventional structure with polar shoe of FIG. 4*a*. Consequently, the intensity of the magnetic field on the axis ZZ' created by the structure with permanent magnets with radial fields of FIG. 4*b* is weaker.

To mitigate the defect in the structure comprising permanent magnets of FIG. 4*b* with a radial magnetization, a toroid-shaped magnetic core 50 with external radius equal to the internal radius r of the permanent magnet 30 can be placed inside the permanent magnet 30, which effectively makes it possible to increase the intensity of the magnetic field on the axis ZZ'.

FIG. 5 shows the field lines of two contiguous magnets of the structure of FIG. 4*b* comprising two magnetic cores 50, the internal radius of which is equal to the internal radius of the pole pieces 20 of FIG. 4*a*.

The structure with radially-magnetized permanent magnets, as represented in FIGS. 4*b* and 5, has another defect. In practice, the magnetic polarization of the magnets A1, A2 does not remain in a transverse plane, the magnetic lines in one of the magnets turn toward the neighboring magnet when the internal r and external R radii of the magnets are approached.

The magnetic flux that crosses the surface Sr based on the internal radius r represents only a fraction of the total flux created by the magnet, which results in a magnetic field in the axis ZZ' that is weak. In order to oppose the flux passing through the lateral faces of the magnets, another permanent magnet, ring-shaped and magnetized axially (or parallel to the axis ZZ') can be placed between two radially-magnetized permanent magnets.

FIG. 6 shows a variant of the structure of FIG. 4*b*.

The structure of FIG. 6 comprises the two radially-magnetized toroidal permanent magnets A1, A2 separated by a third, axially-magnetized, ring-shaped permanent magnet A3.

The structure with three toroidal magnets A1, A2, A3 of FIG. 6 results in an increase in the peak field in the axis ZZ'. This increase in the magnetic field in the axis ZZ' is confirmed by simulation calculations.

The topology of the structure of FIG. 6 with three toroidal magnets is equivalent to that of a conventional beam-containing device with axially-magnetized rings and polar shoes as represented in FIGS. 1 and 2 in which the polar shoes would have been replaced by radially-magnetized rings.

Apart from the magnetic cores, the use of radially- and axially-magnetized rings to produce a PPM concentrator having symmetry of revolution is known (see for example H. A. Leupold et al., Iron-free permanent magnet structure for travelling wave tubes, IEDM 1991, pp 411-414).

The structures with radially-magnetized permanent magnets include another drawback in their implementation because of the difficulty in producing magnetized rings with magnetization at all radial points. An approximation can be produced by gluing a number of radially-magnetized segments to form a complete toroidal core, but the result is not as good.

FIG. 7 represents various curves f variations of magnetic fields CMg calculated for different containing magnets, expressed in gauss as a function of the external radius R of the magnetized ring. The calculations are made for axially- or radially-magnetized rings of different thicknesses Ep, of the same internal radius r=3.2 mm, and of variable external radius R.

In FIG. 7, the curve Ref represents the magnetic field in the axis ZZ' created by a ring of the prior art that is axially magnetized, the curves Ep4.2 and Ep3.2 show the magnetic fields created by radially-magnetized rings of respective thicknesses Ep=4.2 mm and Ep 3.2 mm. The point in FIG. 7 marked Ep4.2+N represents the magnetic field created by the 4.2 mm thick ring with toroidal core and the point marked Ep3.2+N represents the magnetic field created by the 3.2 mm thick ring with toroidal core.

In summary, the structure with radial (or radially-magnetized) magnets without polar shoes has three defects:

- A magnetic field on the axis ZZ' that is weaker than that produced by a conventional containing device because of the absence of polar shoes to guide the flux as close as possible to the axis ZZ'. This defect can be partially compensated by introducing magnetic cores under the magnets.
- Flux lines Ch that are incurved to pass from one magnet to the next instead of remaining in a transverse plane and leaving through the surface corresponding to the internal diameter of the magnet. This defect can be partially compensated by the introduction of an axially-magnetized ring A3 between two radially-magnetized rings.
- Finally, a production problem: rings with radial magnetization cannot be produced. Sections (or segments) of rings must be assembled and then glued together.

Furthermore, to house a thermal sunt, for example a piece of copper replacing the iron of the polar shoes, the volume of the toroidal magnet must be reduced, which reduces the field on the beam containment axis ZZ'.

SUMMARY OF THE INVENTION

In order to mitigate the drawbacks of the microwave frequency tubes of the prior art, the invention proposes a microwave frequency structure for microwave tube comprising a cylindrical vacuum jacket and a device for containing an electron beam in the axis of revolution ZZ' of the cylindrical jacket, the containing device comprising a magnetic structure having p rows R1, R2, . . . , Rp of permanent magnets, distributed at an angular pitch equal to 360°/p around the axis ZZ', p being an integer equal to or greater than 2, each row having n containing permanent magnets e1, e2, . . . ei, . . . en, i being an integer between 1 and n, n being greater than or equal to three, the rows being equidistant from the axis ZZ', the n containing permanent magnets e1, e2, . . . ei, . . . en, being of the same parallelepipedal shapes and having magnetic polarization parallel to one of its edges in a plane transversal to the axis ZZ', their direction of magnetization in the row changing alternately from one containing magnet ei to another next containing magnet ei+1, or preceding containing magnet ei−1, to create an alternating periodic magnetic field along the containment axis ZZ', wherein the magnetic structure of the containing device is unchanging for a rotation of 360°/p of said p rows about the axis ZZ'.

In one embodiment, the containing device comprises a pair of rows of permanent magnets R1, R2 that are symmetrical relative to the axis ZZ', the magnetic polarizations of the containing permanent magnets in one and the same plane transversal to the axis ZZ' having directions of axis CC' passing through the axis ZZ', the magnetic structure of a row R1 being unchanging for the other row R2 in a rotation of 180° about the axis ZZ'.

In another embodiment, the two rows R1, R2 of permanent magnets are separated by a space comprising two cooling channels either side of the axis ZZ', to dispel the calories released by the central portion of the microwave frequency structure toward a cold source.

In another embodiment, the cooling channels are passages in two copper blocks in the space between the two rows R1, R2 of permanent magnets, either side of the axis ZZ'.

In another embodiment, the containing device comprises two pairs of rows of containing permanent magnets e1, e2, . . . ei, . . . en, a first pair comprising two rows R1, R2 and a second pair comprising two other rows R3, R4, the rows being symmetrical in pairs relative to the axis ZZ' and in two perpendicular planes passing through the axis ZZ', the magnetic polarizations of the permanent magnets, in one and the same transverse plane relative to the axis ZZ', having directions of axis CC' passing through the axis ZZ', the magnetic structure of one pair being unchanging for the other pair in a rotation of 90° about the axis ZZ'.

In another embodiment, each containing magnet ei of a row R1, R2, . . . Rp is sandwiched, on an axis SS' perpendicular to the polarization axis CC' of the containing permanent magnet ei, between two secondary permanent magnets shi, sbi, of row i, of the same parallelepipedal shapes, the two secondary magnets having magnetic polarizations of the same axis SS' and of opposing polarization directions, the magnetization directions of two secondary magnets shi, sbi changing alternately from one containing magnet ei to another next containing magnet ei+1 or preceding containing magnet ei−1 of each row of permanent magnets.

In another embodiment, the containing device comprises two pairs of adjacent rows of containing permanent magnets e1, e2, . . . ei, . . . en, about the axis ZZ', a first pair comprising two rows R1, R2 and a second pair comprising two other rows R3, R4, each containing permanent magnet of parallelepipedal shape having long sides and short sides perpendicular to the long sides, a long side of a containing magnet ei of one row being in contact by a short side of a magnet ei of another adjacent row so that the four magnets ei of the four adjacent rows R1, R2, R3, R4, in one and the same plane transversal to the axis ZZ', delimit a square centered on the axis ZZ', the magnetic polarizations of the containing permanent magnets ei, in one and the same transverse plane, having directions of axis DD' perpendicular to the long sides of the containing permanent magnet, the magnetic structure of the first pair P1 of rows R1, R2 being unchanging by rotation of 180° about the axis ZZ', like the magnetic structure of the second pair P2 of rows R3, R4, the first pair P1 of rows R1, R2 being converted into the second pair P2 of rows R3, R4 by a rotation of 90° about the axis ZZ".

In another embodiment, the containing permanent magnets ei of rank i, in one and the same transverse plane, are separated from the containing permanent magnets ei+1, of next rank i+1, or ei−1 of preceding rank i−1, by fins made of heat-conducting metal so as to evacuate the heat released into the cylindrical vacuum jacket toward cooling channels of the microwave frequency structure.

In another embodiment, each row R1, R2, . . . Rp of containing permanent magnets e1, e2, . . . ei, . . . en, comprises a series of auxiliary magnets ax1, ax2, . . . axi, . . . axn−1, of the same parallelepipedal shapes, an auxiliary magnet axi of the series being inserted between two containing magnets ei, e+1, with a polarization axis AA' parallel to the axis ZZ', an auxiliary magnet axi between two containing magnets having a polarization of opposite direction to a next auxiliary magnet axi+1, or preceding auxiliary magnet axi−1, of the series of auxiliary magnets in each row.

In another embodiment, the containing magnets e1, e2, . . . ei, . . . en, of transverse magnetization, comprise magnetic cores between the rows R1, R2, . . . Rp of containing permanent magnets, these cores being positioned, on the axes ZZ' and YY', in the middle of said containing magnets to increase the intensity of the magnetic field in the axis ZZ'.

In another embodiment, the containing magnets e1, e2, . . . ei, . . . en, of transverse magnetization, comprise field correcting magnetic cores between the rows R1, R2, . . . Rp of containing permanent magnets, these field correcting cores being positioned, on the axis ZZ', level with the faces in contact between two adjacent containing magnets ei, ei+1 and, on the axis YY', in the middle of said containing magnets in order to produce a non-sinusoidal magnetic field.

In another embodiment, the auxiliary magnets ax1, ax2, . . . axi, . . . axn−1 comprise magnetic cores between the rows R1, R2, . . . Rp of containing permanent magnets, these cores being positioned, on the axis ZZ' and the axis YY', in the middle of the auxiliary magnets ax1, ax2, . . . axi, . . . axn−1 having a magnetization parallel to the axis ZZ' in order to produce a non-sinusoidal magnetic field, similar to that used for TWTs with coupled cavities.

The invention also relates to a microwave frequency tube comprising a microwave frequency structure according to the invention, and notably a traveling wave tube (TWT).

A main objective of the invention is to enhance the cooling of the microwave frequency structures of the tubes that include a beam-containing device with alternating magnetic field.

Another objective of the invention is to produce a beam-containing magnetic device that is simple to produce with containment field performance levels that are equivalent to or better than those of the prior art devices.

BRIEF DESCRIPTION OF THE DRAWINGS

The invention will be better understood from the description of an exemplary embodiment of a microwave frequency structure according to the invention, with the aid of indexed drawings in which.

DETAILED DESCRIPTION

Figure 1:
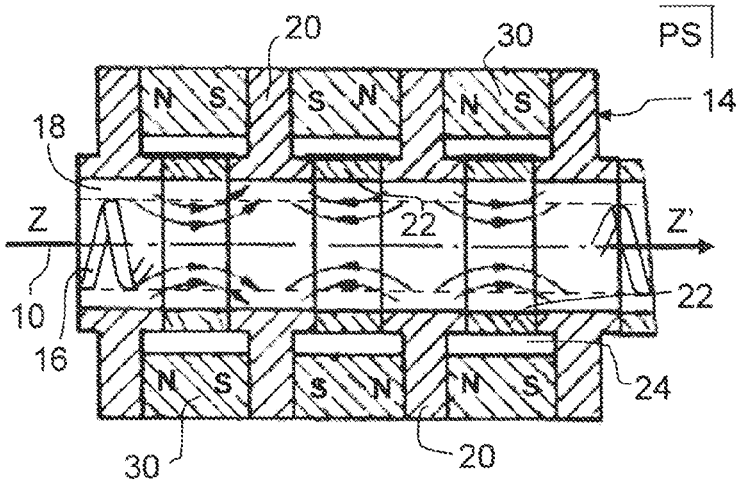
FIG. 1, already described, represents a partial cross-sectional view of a microwave frequency structure of a helix TWT of the prior art.
Figure 2:
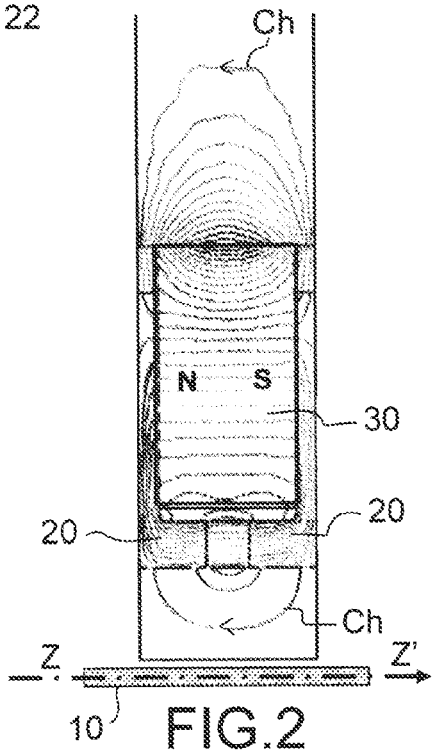
FIG. 2, already described, represents a partial cross-sectional view of a section of the sheath 14 of the structure of FIG. 1.
Figure 3:
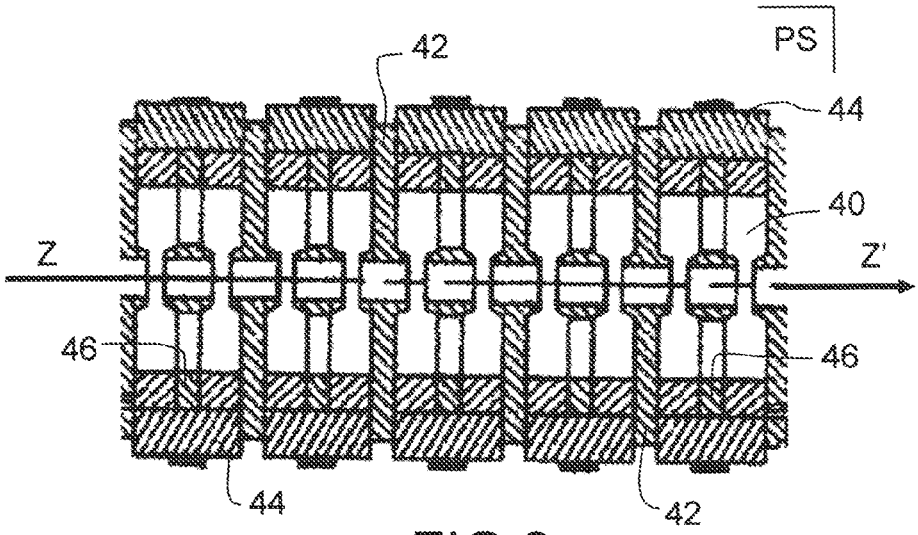
FIG. 3, already described, presents a partial cross-sectional view of a microwave frequency structure of a coupled-cavity TWT.
Figure 4A:
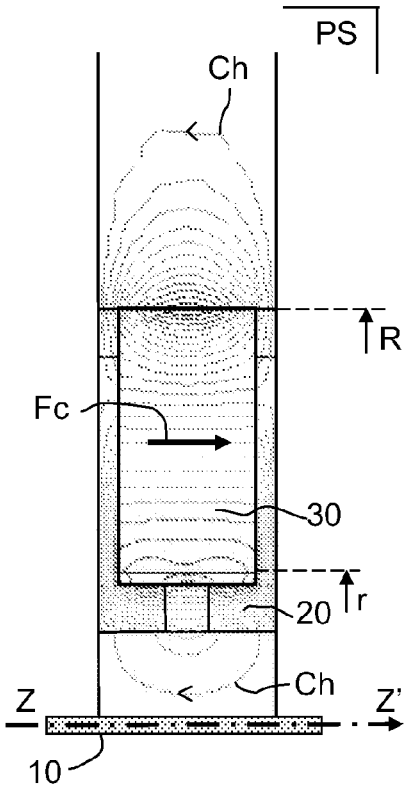
FIG. 4*a*, already described, shows a partial view of the sheath, showing the field lines of the permanent magnet of FIG. 2.
Figure 4B:
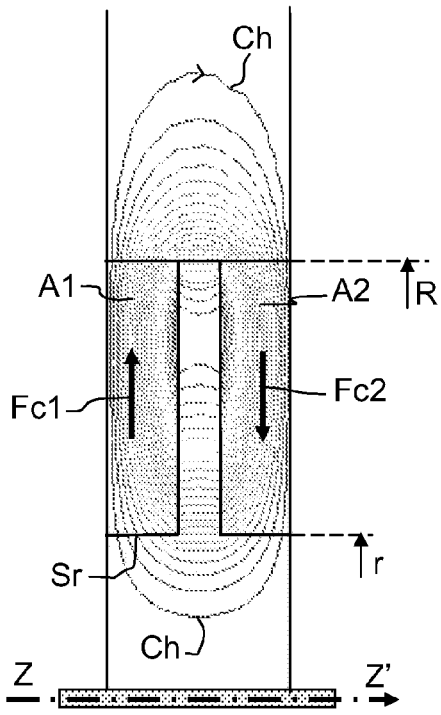
FIG. 4*b*, already described, shows a partial view of another structure comprising two toroid-shaped permanent magnets.
Figure 5:
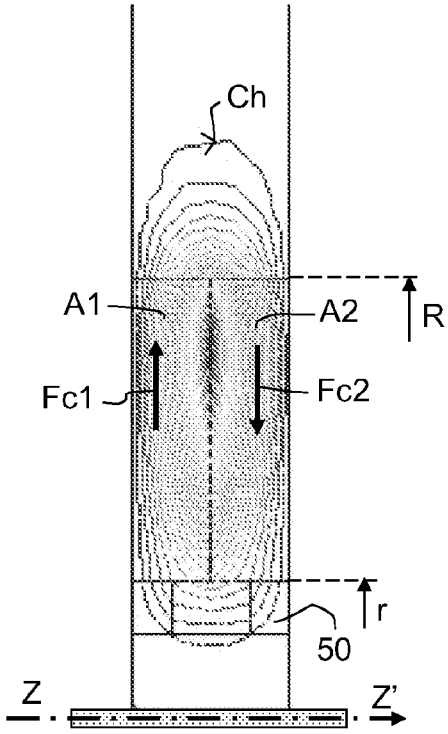
FIG. 5, already described, shows the field lines of two contiguous magnets of the structure of FIG. 4*b;*
Figure 6:
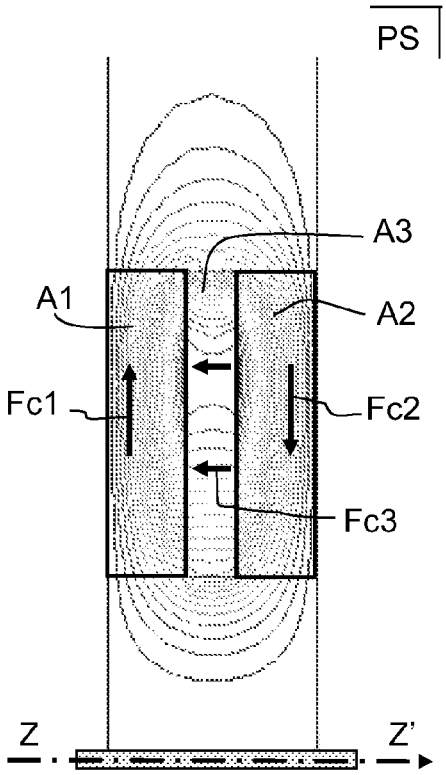
FIG. 6 shows a variant of the structure of FIG. 5.
Figure 7:
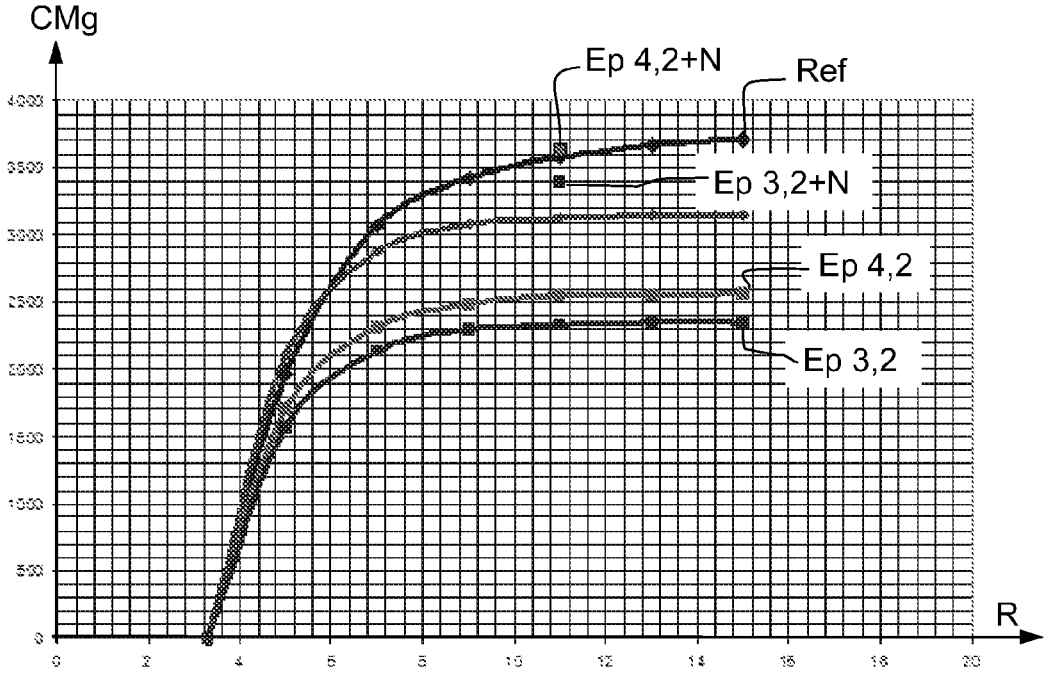
FIG. 7, already described, shows different curves of the magnetic field CMg variations calculated for different containing magnets.
Figure 8A:
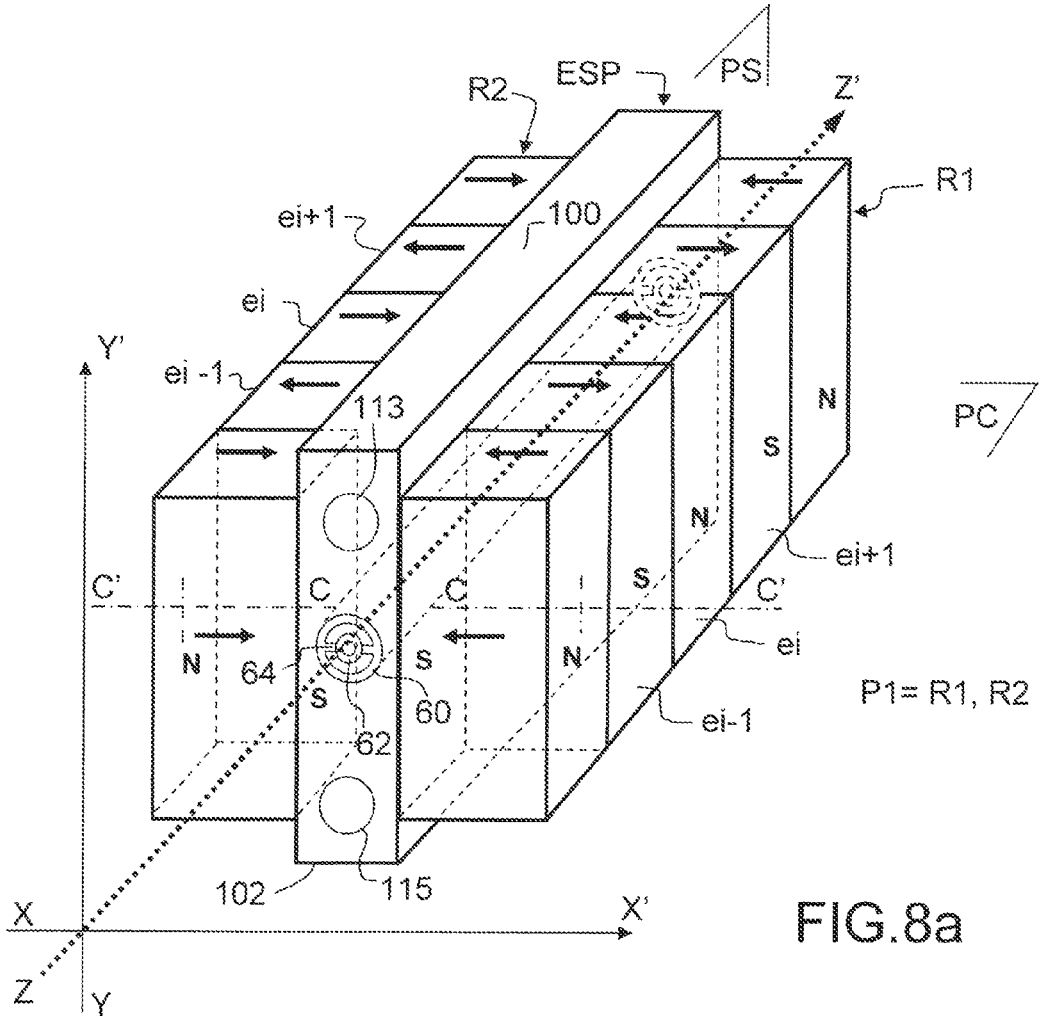
FIG. 8*a* shows a partial view of a first embodiment, according to the invention, of a microwave frequency structure for microwave tube.

FIG. 8*a* shows a partial view of a first embodiment, according to the invention, of a microwave frequency structure for microwave tubes, in this example a helix TWT.

The microwave frequency structure of FIG. 8*a* comprises a vacuum jacket 60 in the form of a cylindrical tube, of axis of revolution ZZ'. The vacuum jacket contains a cylindrical helix 62 secured in the jacket colinearly to the axis ZZ' by insulating supports 64 and forming a propagation line for the microwave frequency wave from the TWT.

A TWT electron gun (not represented in the figure) generates an electron beam along the axis ZZ' of the helix, also referred to hereinafter as electron beam containment axis. To this end, the microwave frequency structure comprises, according to a main feature of the invention, a pair P1 (or p=2) of rows of permanent magnets R1, R2 that are symmetrical in relation to the axis ZZ'. The rows R1, R2 either side of a plane of symmetry Ps passing through the containment axis ZZ', each comprise n containing permanent magnets e1, e2, . . . ei, . . . en (with i being an integer between 1 and n, n being equal to or greater than three).

Hereinafter, the various embodiments will be identified in position in relation to a coordinate system of three axes XX', YY', ZZ', the axis ZZ' being the beam containment axis.

The containing permanent magnets e1, e2, . . . ei, . . . en have one and the same parallelepipedal shape (or block shape) with a magnetic polarization in the row of axis CC' in a containment plane Pc perpendicular to the plane of symmetry Ps and passing through the axis ZZ'. The direction of magnetization of the containing magnets changes alternately from one containing magnet ei to another next containing magnet ei+1 or preceding containing magnet ei−1, in each row R1, R2 of magnets, to provide an alternating periodic magnetic field along the containment axis ZZ'.

Because of the symmetry of the device, the magnets of the same rank i of the two rows R1, R2 facing each other either side of the axis ZZ' have fields of opposing directions. The magnetic structure of a row R1 is therefore unchanging for the other row R2 in a rotation of 180° about the axis ZZ'.

Figure 8B:
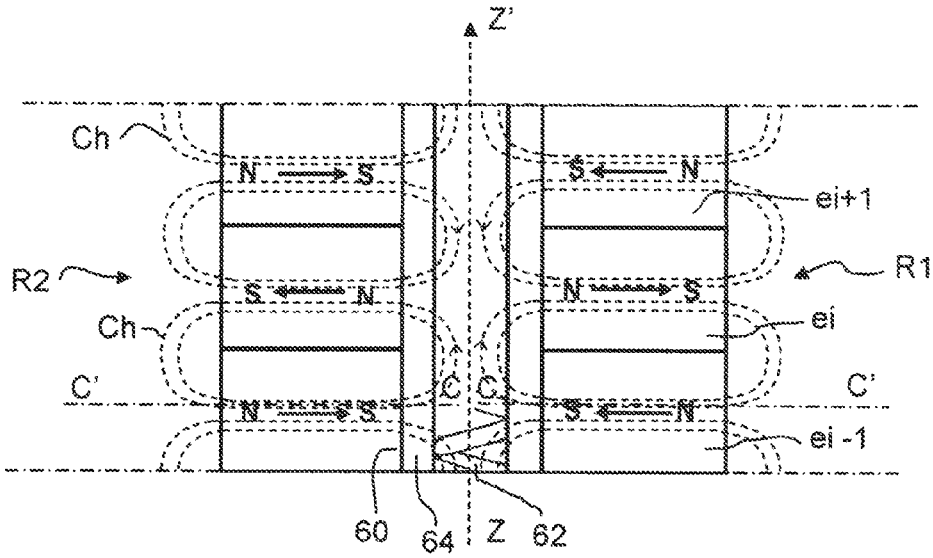
FIG. 8*b* shows a cross-sectional view of the structure of FIG. 9*a;*

FIG. 8*b* represents a cross-sectional view of the structure of FIG. 8*a*, along the containment plane Pc passing through the axis ZZ' parallel to the magnetic polarization axes CC' of the containing magnets.

FIG. 8*b* shows the field lines Ch, generated by the containing device, symmetrical relative to the axis ZZ' in the jacket 60.

The embodiment of FIG. 8*a* requires only two rows R1, R2 of identical contiguous permanent magnets, but is not optimal for two reasons:

the magnetic field created by the device exhibits a slow decrease along the axis YY', while the magnetic field is necessary only in the vicinity of the beam in the axis ZZ', the magnetic flux lines pass from one containing magnet ei to the adjacent magnet ei+1 or ei−1, instead of remaining parallel to the axis XX' as far as the electron beam.

Figure 9A:
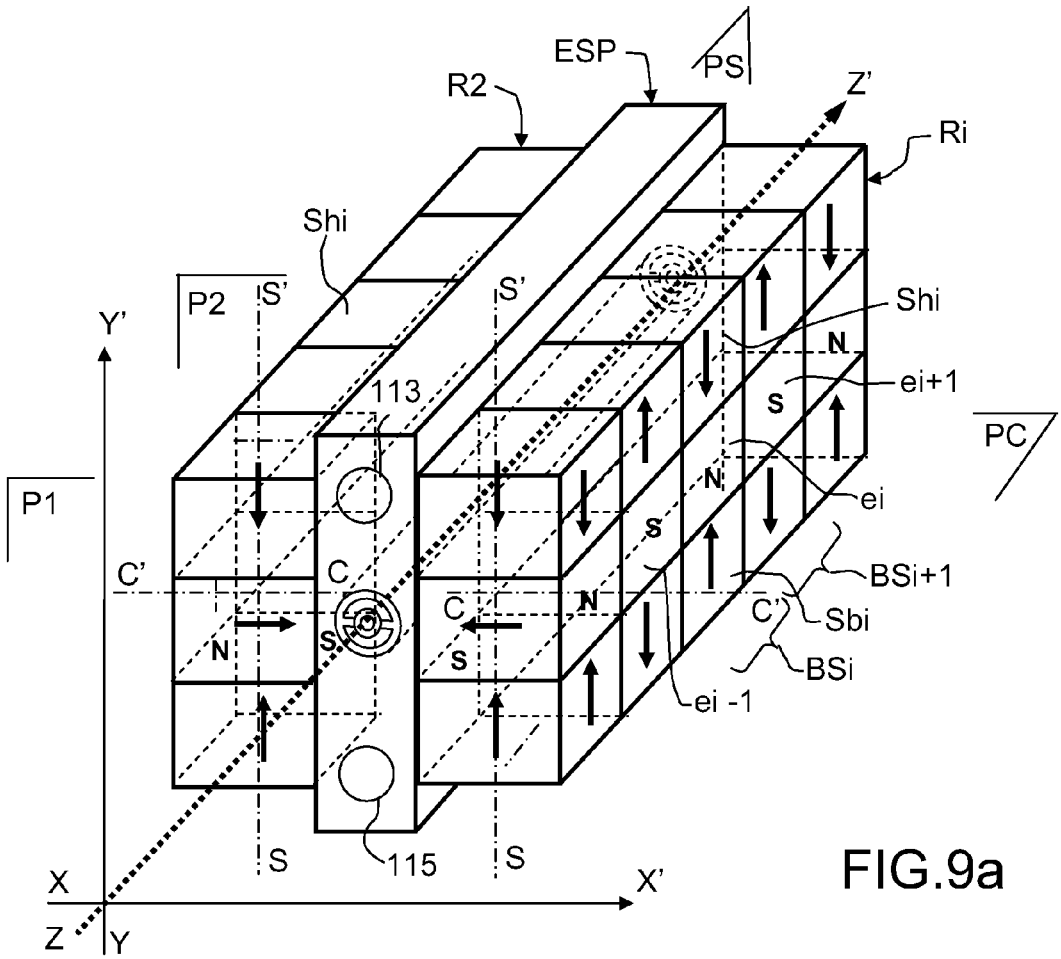
FIG. 9*a* shows a partial view of a variant of the embodiment of FIG. 8*a*, according to the invention.

FIG. 9*a* shows a partial view of a variant of the first embodiment of FIG. 8*a*, according to the invention.

Figure 9B:
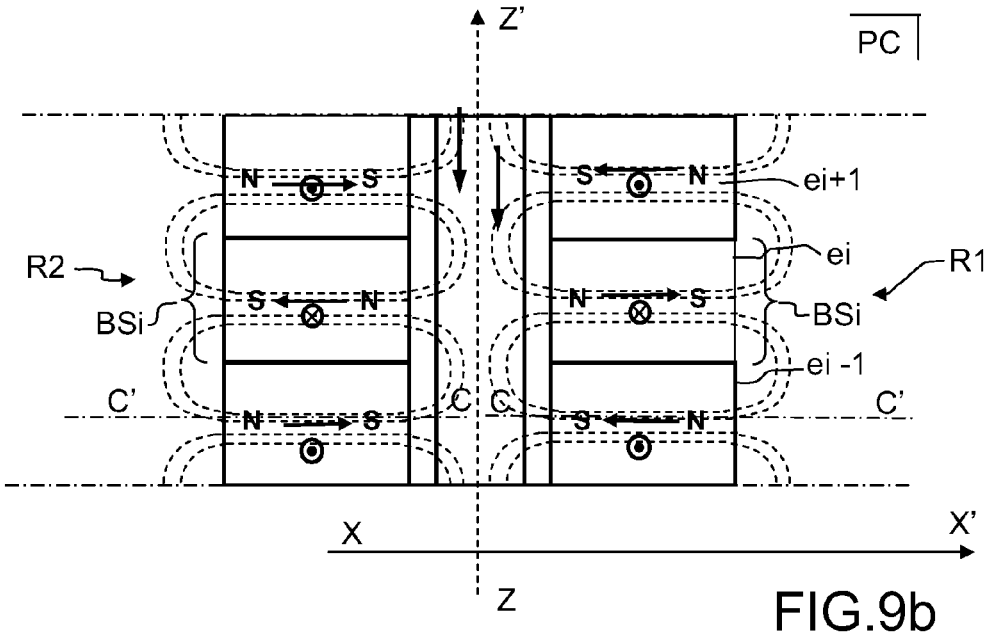
FIG. 9*b* shows a partial cross-sectional view of the structure of FIG. 9*a;*

FIG. 9*b* shows a partial cross-sectional view, along the containment plane Pc, of the structure of FIG. 9*a*.

The variant represented in FIG. 9*a* provides enhancements compared to that of FIG. 8*a* consisting in concentrating, on a first axis YY', the magnetic field produced by the containing magnets on the useful area of passage of the beam in the axis ZZ'.

To concentrate the magnetic field on the useful area of containment of the beam, and therefore over a shorter distance along the axis YY', two other secondary magnets shi, sbi of rank i are added either side of each containing permanent magnet ei in each row R1, R2 of the embodiment of FIG. 8*a*, said other secondary magnets being magnetized along axes SS' that are perpendicular to the polarization axis CC' of the containing permanent magnet ei, the polarizations of the secondary magnets having opposing directions. As for the containing magnets, the directions of magnetization of the two secondary magnets shi, sbi change alternately from one containing magnet ei to another next containing magnet ei+1 or preceding containing magnet ei−1 of each row of permanent magnets.

In this embodiment, a block BSi of rank i of the row R1 of three permanent magnets comprising the containing magnet ei of rank i magnetized in a direction directed toward the axis ZZ' sandwiched between the two secondary magnets shi, sbi of rank i magnetized in contrary directions directed toward the containing magnet ei, is followed by another block BSi+1 of rank i+1 of three other permanent magnets, comprising the containing magnet ei+1 of rank i+1, sandwiched between two secondary magnets shi+1, sbi+1 of rank i+1, with directions of magnetization opposing those of the magnets of the preceding block Bi.

The two rows R1, R2 of magnets are symmetrical either side of the plane of symmetry Ps and two blocks BSi of the same rank i either side of the plane of symmetry Ps have symmetrical magnetic polarizations.

To obtain a periodic magnetic field, the magnetization of the two symmetrical blocks BSi of the row R1 and symmetrical BSi of the row R2 changes direction upon displacement by a half-period along the axis ZZ'. A magnetic pitch (or following half-period along the axis ZZ') of the microwave frequency structure therefore comprises six magnets of two different types.

Figure 10A:
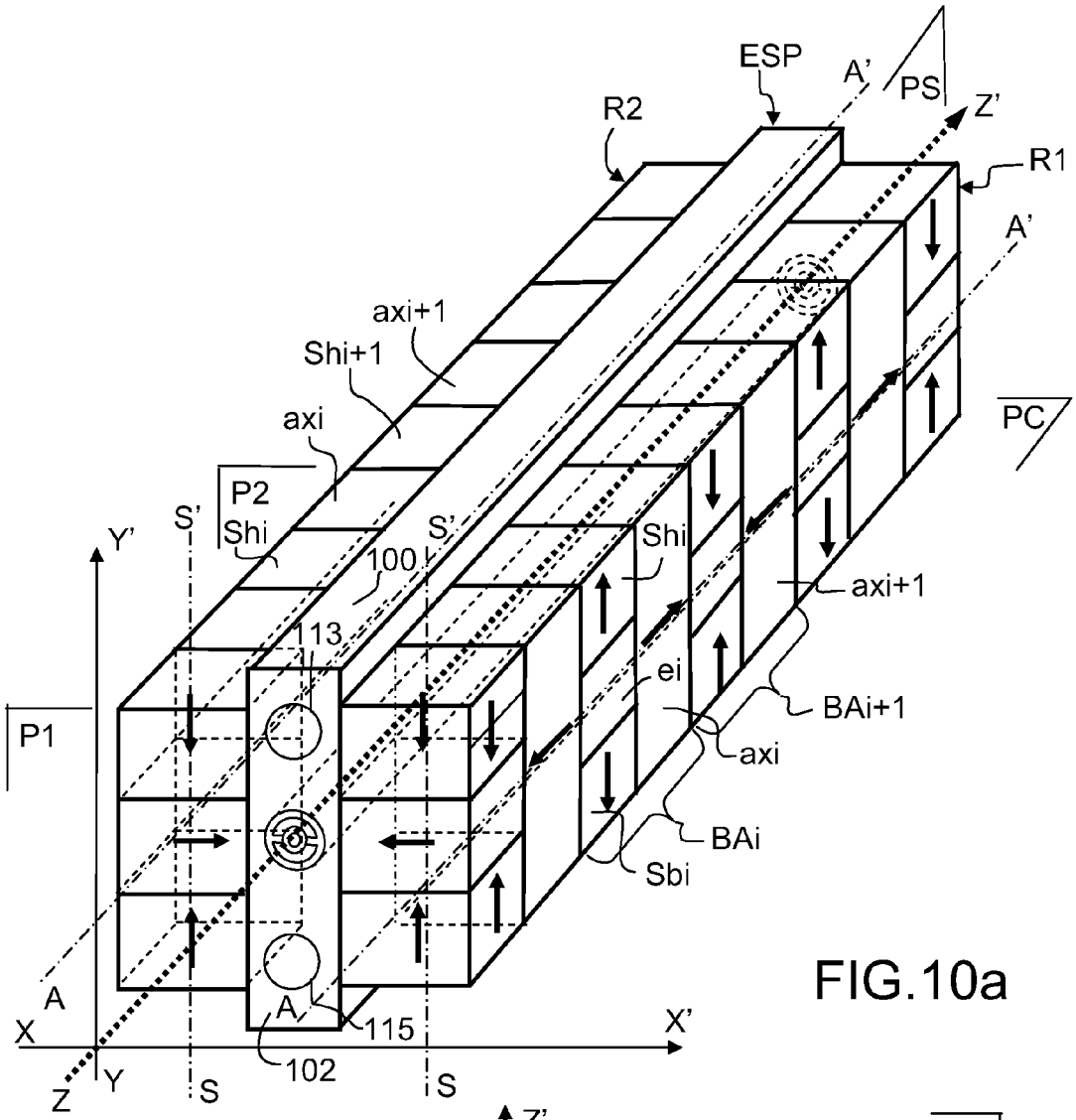
FIG. 10*a* shows a partial view of another variant of the first embodiment of FIG. 8*a*, according to the invention.

FIG. 10*a* shows a partial view of another variant of the first embodiment of FIG. 8*a*, according to the invention.

Figure 10B:
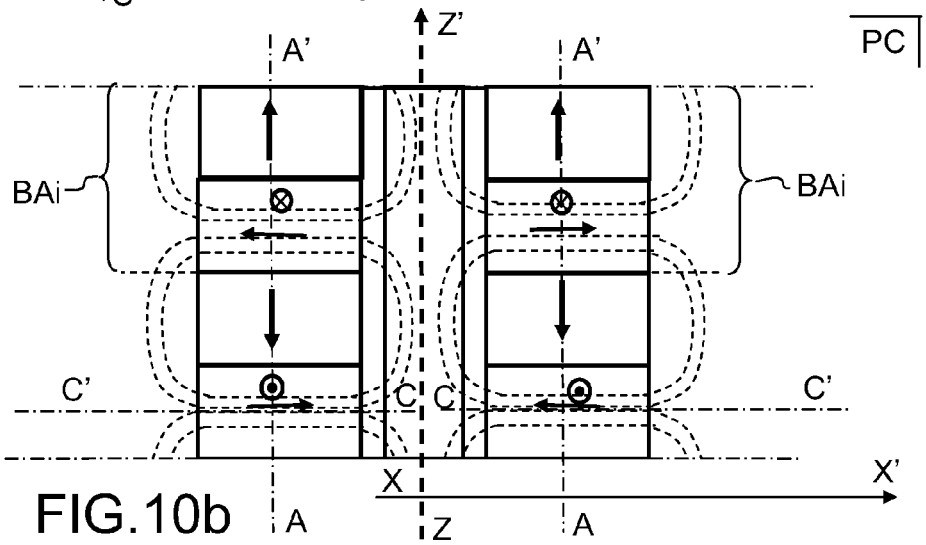
FIG. 10*b* shows a partial cross-sectional view of the structure of FIG. 10*a;*

FIG. 10*b* shows a partial cross-sectional view of the structure of FIG. 10*a*.

This other variant embodiment of FIG. 10*a* provides enhancements compared to that of FIG. 9*a* consisting in concentrating, along a second axis XX', the magnetic field produced by the containing magnets on the useful area of passage of the beam, in the axis ZZ'.

To concentrate the magnetic field on the useful area of containment of the beam, and therefore over a shorter distance along the axis XX', each row R1, R2 of containing permanent magnets comprises a series of auxiliary magnets ax1, ax2, . . . axi, . . . axn−1, of the same parallelepipedal shapes as the other magnets of the row, inserted between the containing magnets e1, e2, . . . ei, . . . en sandwiched between the secondary magnets shi, sbi.

In this configuration of FIG. 10*a*, an auxiliary magnet axi of rank i of the series is inserted between two containing magnets with a polarization axis AA' perpendicular to the polarization axis CC' of the containing magnet and in such a way that an auxiliary magnet axi of rank i between two containing magnets offers a polarization with a direction opposing a next auxiliary magnet axi+1 or preceding auxiliary magnet axi−1 of the series of auxiliary magnets in each row R1, R2.

In this other variant represented in FIG. 10*a*, a block BAi of the row R of rank i comprises four permanent magnets, a containing magnet ei of rank i magnetized in a direction directed toward the axis ZZ' sandwiched between two secondary magnets shi, sbi magnetized in contrary directions directed toward the containing magnet ei, an auxiliary magnet axi, alongside the block BAi contiguous to the next block BAi+1, with a magnetic polarization of axis AA' perpendicular to the magnetic polarization of axis CC' of the containing magnet ei and with a direction directed toward the containing magnet ei of the block BAi concerned.

A block BAi of the row R1, R2 is followed by another block BAi+1 of rank i+1 of four other permanent magnets, but with directions of magnetization opposing those of the magnets of the preceding block BAi.

The two rows R1, R2 of magnets are symmetrical either side of the plane of symmetry Ps and two blocks BSi each of four permanent magnets of the same rank i either side of the plane of symmetry Ps have symmetrical magnetic polarizations.

In the first embodiment of FIG. 8*a* and its variants of FIGS. 9*a* and 10*a*, according to the invention, the two rows R1, R2 of permanent magnets are separated by a space ESP comprising two cooling channels 113, 115 either side of the axis ZZ', for evacuating the calories released by the central portion of the microwave frequency structure toward a cold source. This central portion of the microwave frequency structure comprises a microwave frequency line in the vacuum jacket 60.

In a preferred embodiment, the cooling channels are passages in two copper blocks 100, 102 in the space (ESP) between the two rows R1, R2 of permanent magnets, either side of the axis ZZ'. These copper blocks, in the plane of symmetry Ps, are in thermal contact with the vacuum cylindrical jacket 60 and make it possible to evacuate calories via the cooling channels 113, 115 toward the cold source.

Figure 11A:
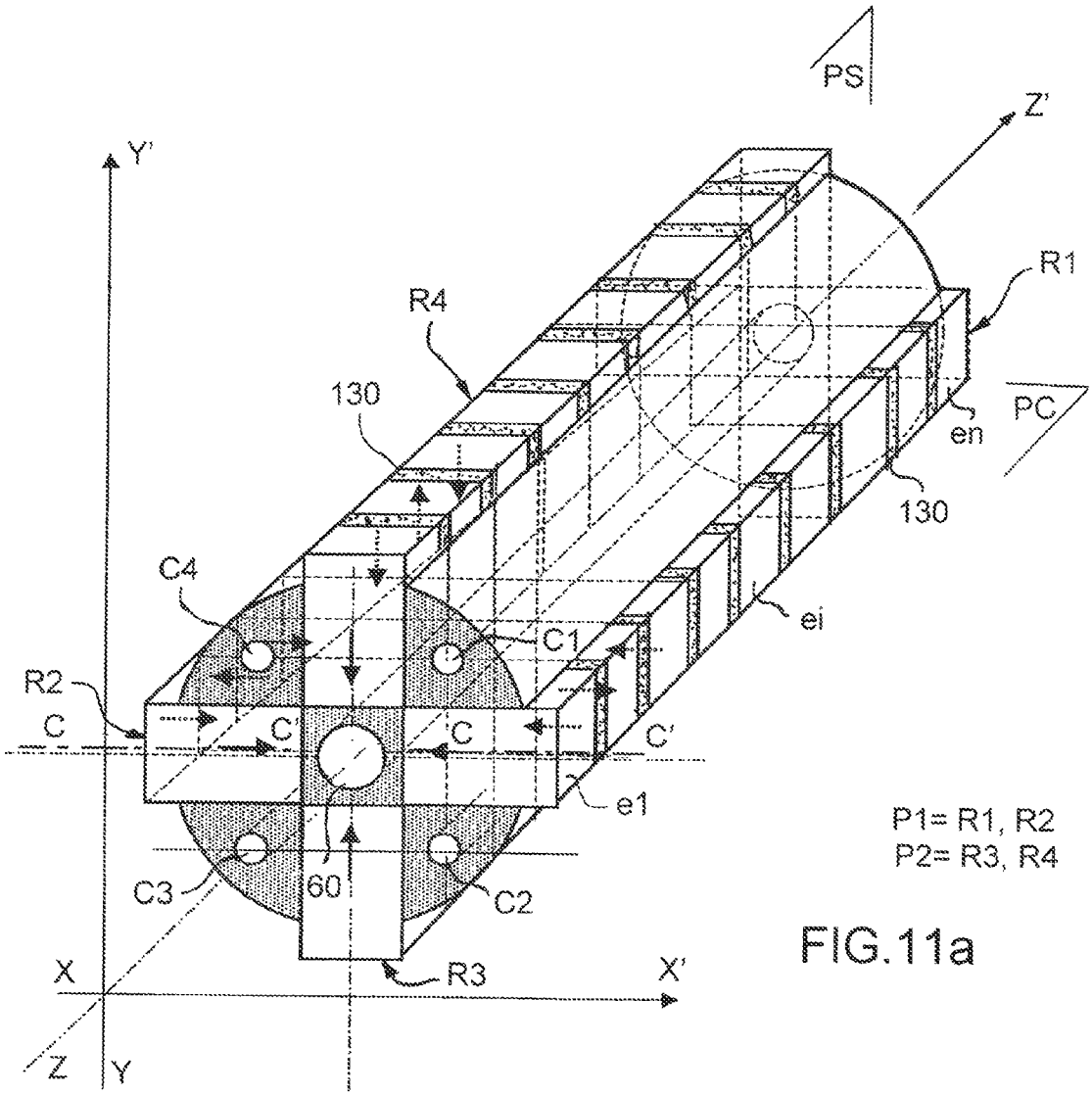
FIG. 11*a* shows a perspective view of a second embodiment, according to the invention, of a microwave frequency structure for microwave tube.

FIG. 11*a* shows a perspective view of a second embodiment, according to the invention, of a microwave frequency structure for microwave tubes, in this example a helix TWT.

The microwave frequency structure of FIG. 11*a* comprises, as in the case of the first embodiment, the vacuum jacket 60 in the form of a cylindrical tube, of axis of revolution ZZ'.

In this second embodiment of FIG. 11*a*, the containing device comprises two pairs of rows of containing permanent magnets (or p=4), the first pair P1 comprising two rows R1, R2 and the second pair P2 comprising two other rows R3, R4.

The rows are symmetrical in pairs relative to the axis ZZ' and in the two perpendicular planes Pc, Ps passing through the axis ZZ'.

The magnetic polarizations of the containing permanent magnets e1, e2, . . . ei, . . . en, of the rows, in one and the same transverse plane relative to the axis ZZ', have directions of axis CC' passing through the axis ZZ'. In this second embodiment, the magnetic structure of one pair P1 of rows R1, R2 is unchanging for the other pair P2 of rows R3, R4 in a rotation of 90° about the axis ZZ'.

The cooling of the vacuum jacket is provided by cooling channels C1, C2, C3, C4 between the rows of permanent magnets.

To enhance the cooling, in this structure with four perpendicular rows of magnets R1, R2, R3, R4, the containing permanent magnets of rank i, in one and the same transverse plane, are separated by permanent magnets of next rank i+1 or preceding rank i−1 by fins 130 made of heat-conducting metal so as to evacuate the heat released in the vacuum cylindrical jacket toward the cooling channels C1, C2, C3, C4 of the structure.

Figure 11B:
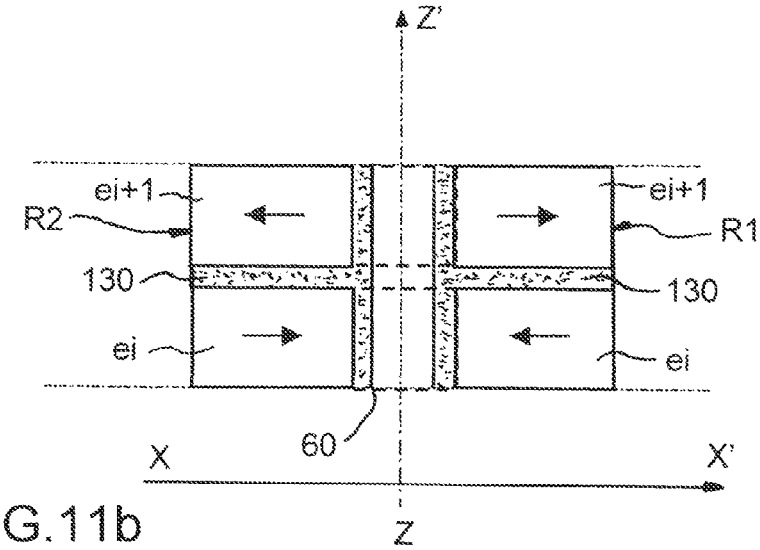
FIG. 11*b* shows a partial cross-sectional view of the structure of FIG. 11*a;*
Figure 12A:
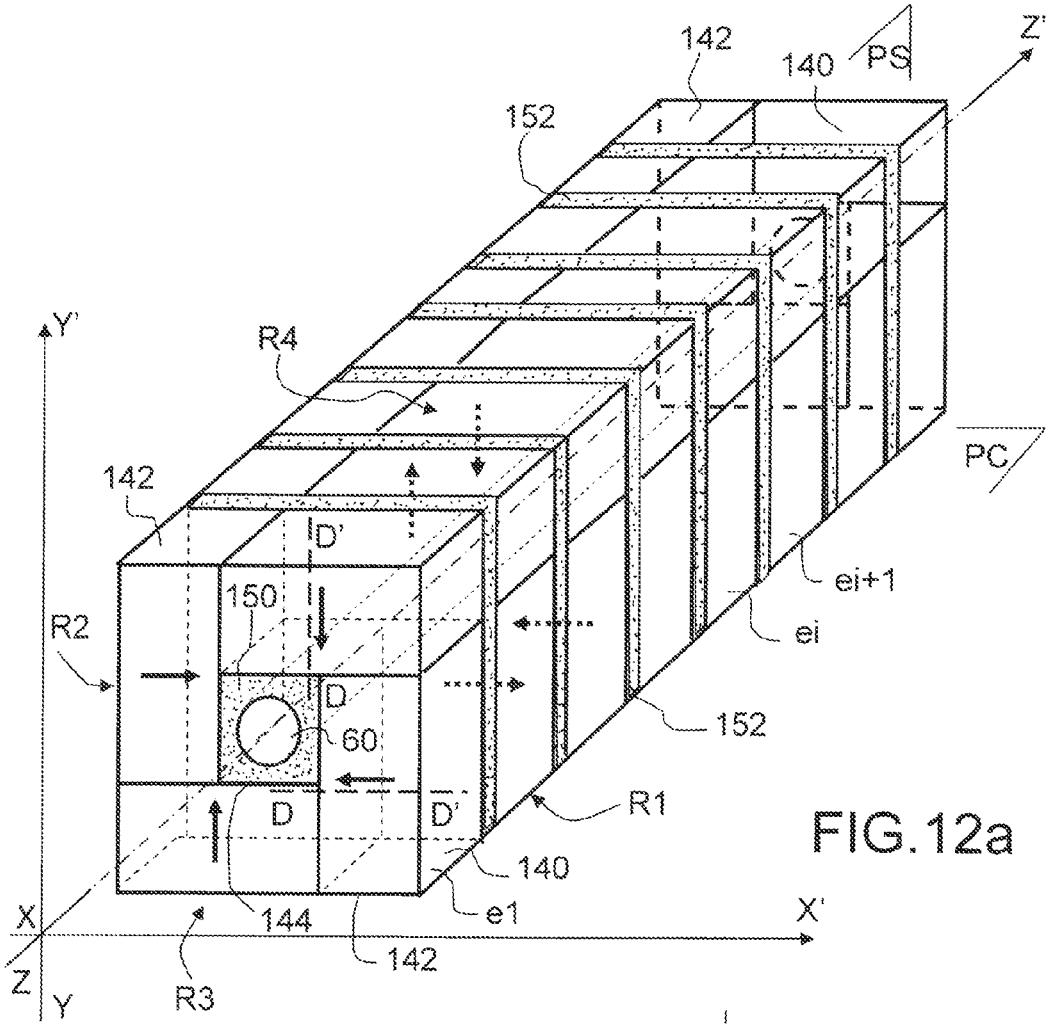
FIG. 12*a* shows a perspective view of a third embodiment, according to the invention, of a microwave frequency structure for microwave tube.

FIG. 11*b* shows a partial cross-sectional view of the structure of FIG. 12*a*. The cross section is produced on the plane Pc passing through the axis ZZ'.

FIG. 11*b* shows the cooling fins 130 of the cylindrical jacket containing the microwave frequency line.

FIG. 12*a* shows a perspective view of a third embodiment, according to the invention, of a microwave frequency structure for microwave tubes, in this example a helix TWT.

The microwave frequency structure of FIG. 12*a* comprises, as in the case of the first and second embodiments, the vacuum jacket 60 in the form of a cylindrical tube, of axis of revolution ZZ'.

In this third embodiment of FIG. 12*a*, the containing device comprises two pairs of adjacent rows of containing permanent magnets e1, e2, . . . ei, . . . en, around the axis ZZ', a first pair P1 comprising two rows R1, R2 and a second pair P2 comprising two other rows R3, R4.

Each containing permanent magnet of parallelepipedal shape comprises long sides 140 and short sides 142 perpendicular to the long sides. A long side 140 of a containing magnet ei of a row is in contact with a short side 142 of a containing magnet of another adjacent row so that the four magnets ei of the four adjacent rows R1, R2, R3, R4, in one and the same plane transversal to the axis ZZ', delimit a square 144 centered on the axis ZZ'.

The size of the containing magnets is such that the magnets in contact leave an internal square-shaped space 150 centered on the axis ZZ' for the passage of the vacuum jacket 60.

The magnetic polarizations of the containing permanent magnets, in one and the same transverse plane, have directions of axis DD' perpendicular to the long sides of the permanent magnet. In this embodiment, the magnetic structure of the first pair P1 of rows R1, R2 is unchanging in rotation of 180° about the axis ZZ', like the magnetic structure of the second pair P2 of rows R3, R4. Furthermore, the first pair of rows R1, R2 is converted into the second pair P2 of rows R3, R4 by a rotation of 90° about the axis ZZ'.

As in the second embodiment of FIG. 11*a*, the permanent magnets of rank i in one and the same transverse plane are separated by permanent magnets of next rank i+1 or preceding rank i−1 by fins 152 made of heat-conducting metal so as to evacuate the heat released in the vacuum cylindrical jacket 60 toward external cooling channels (not represented in the figures). These cooling channels are further away from the vacuum jacket, but this third configuration makes it possible to implement containing permanent magnets of a larger size and therefore that produce a more intense magnetic field on the axis ZZ'.

Figure 12B:
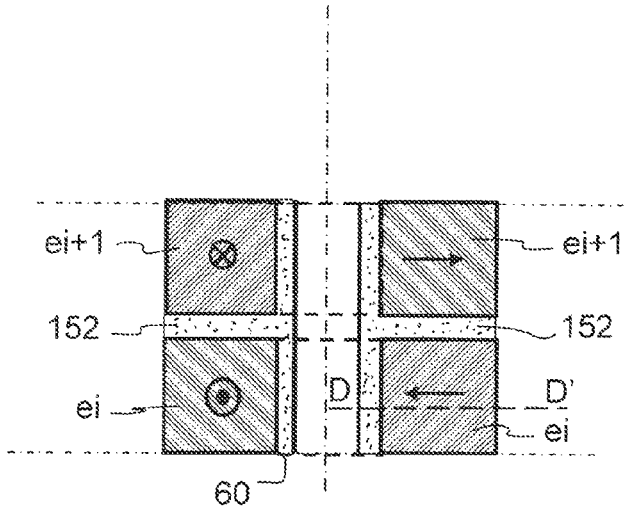
FIG. 12*b* shows a partial cross-sectional view of the structure of FIG. 12*a;*

FIG. 12*b* shows a partial cross-sectional view of the structure of FIG. 12*a*. The cross-sectional plane Pc passes through the axes ZZ' and XX' of the device of FIG. 13*a*.

FIG. 12*b* shows the cooling fins 152 of the cylindrical jacket 60 containing a microwave frequency line.

In other variant embodiments described previously, the blocks of magnets comprise, between the rows, different types of magnetic cores.

Figure 13:
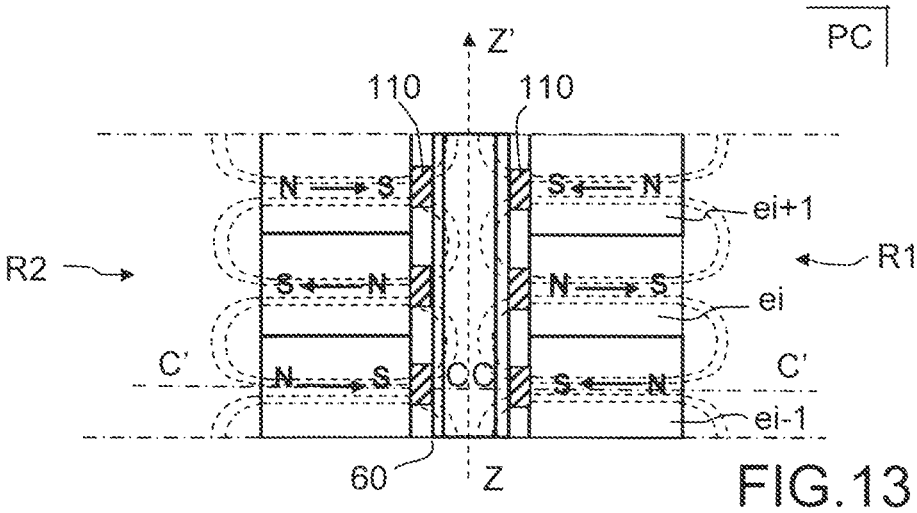
FIG. 13 shows an exemplary embodiment of the microwave frequency structure of FIG. 8*b* with magnetic cores.

FIG. 13 shows the exemplary microwave frequency structure embodiment of FIG. 8*b* with magnetic cores.

The containing magnets e1, e2, . . . ei, . . . en, of transverse magnetization, comprise magnetic cores 110 between the rows R1, R2, . . . Rp. These cores are positioned along the axes ZZ' and YY', in the middle of said containing magnets to increase the intensity of the magnetic field in the axis ZZ'.

Figure 14:
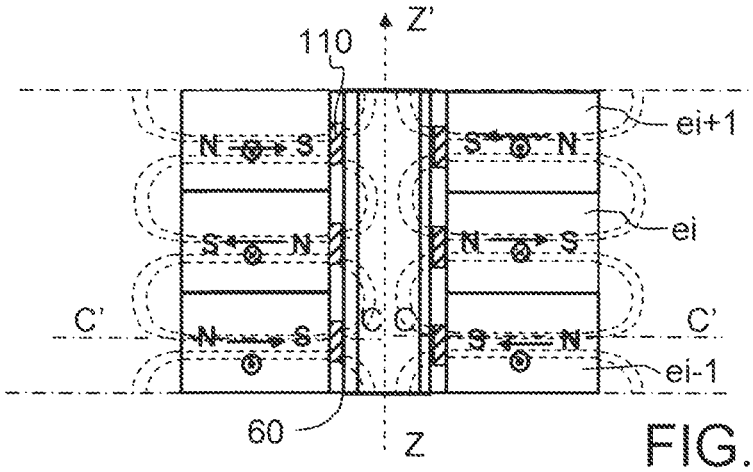
FIG. 14 shows an exemplary embodiment of the microwave frequency structure of FIG. 9*b* with magnetic cores.

FIG. 14 shows the exemplary microwave frequency structure embodiment of FIG. 9*b* with the same type of magnetic core as that of FIG. 13 to increase the intensity of the magnetic field in the axis ZZ'. These cores are positioned, along the axes ZZ' and YY', in the middle of said containing magnets.

Figure 15:
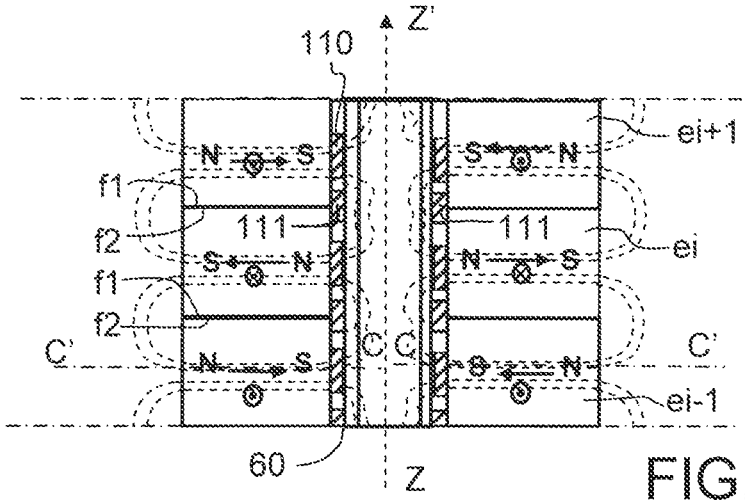
FIG. 15 shows an exemplary embodiment of the structure of FIG. 9*b* with two types of magnetic core.

FIG. 15 shows the exemplary embodiment of the structure of FIG. 9*b* with two types of magnetic cores.

In the embodiment of FIG. 15, the containing magnets e1, e2, . . . ei, . . . en, of transverse magnetization, comprise magnetic cores 110 between the rows R1, R2, . . . Rp, positioned, along the axes ZZ' and YY', in the middle of said containing magnets to increase the intensity of the magnetic field in the axis ZZ' and field-correcting magnetic cores 111 between the rows R1, R2, . . . Rp of containing permanent magnets. These field-correcting cores 111 are positioned, along the axis ZZ', level with the faces f1, f2 in contact between two adjacent containing magnets ei, ei+1 and, along the axis YY', in the middle of said containing magnets in order to produce a non-sinusoidal magnetic field.

Figure 16:
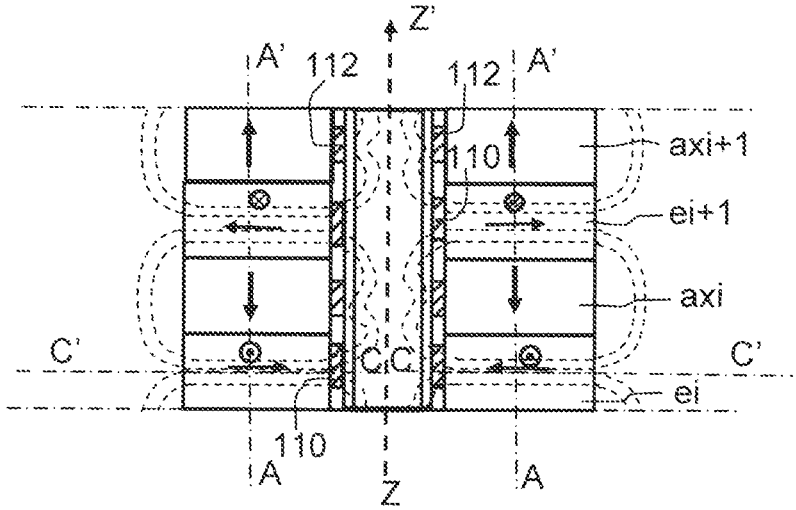
FIG. 16 shows an exemplary embodiment of the structure of FIG. 10*b* with two types of magnetic cores.

FIG. 16 shows an exemplary embodiment of the structure of FIG. 10*b* with two types of magnetic cores.

The embodiment of FIG. 16 comprises, in addition to the magnetic cores 110 in order to increase the field in the axis ZZ', field-correcting magnetic cores 112 positioned, along the axis ZZ' and the axis YY', in the middle of the auxiliary magnets ax1, ax2, . . . axi, . . . axn−1, of magnetization parallel to the axis ZZ', in order to produce a non-sinusoidal magnetic field, similar to that used for the coupled-cavity TWTs.

The various embodiments of microwave frequency structures according to the invention that have been described make it possible to obtain beam-containing alternating magnetic field performance levels that are equal to or even greater than those obtained with axially magnetized rings according to the prior art. In addition, the use of parallelepipedal magnets makes it possible to reduce the size of the containing device with permanent magnets and provide better cooling of the central portion of the structure containing the microwave frequency line.

The structures described are not limiting and other variant configurations of magnets and of the rows of magnets can be adapted to various other applications of the microwave frequency tubes.

For example, in other embodiments, the number p of rows can be an odd number. For example, if p=3, the magnetic structure of the containing device is unchanging for a rotation of 360°/3=120° of said p rows about the axis ZZ'.

The structures have been described in the case of a large number of alternations for long TWT-type tubes, but other structures with two or three alternations can be produced by the containing device, according to the invention, for short tubes such as klystrons.

The invention claimed is:

1. A microwave frequency structure for microwave tube comprising:

a cylindrical vacuum jacket and a device for containing an electron beam in the axis of revolution ZZ' of the cylindrical jacket, the containing device comprising a magnetic structure having p rows R1, R2, . . . , Rp of permanent magnets, distributed at an angular pitch equal to 360°/p around the axis ZZ', p being an integer equal to or greater than 2, each row having n containing permanent magnets e1, e2, . . . ei, . . . en, i being an integer between 1 and n, n being greater than or equal to three, the rows being equidistant from the axis ZZ', the n containing permanent magnets e1, e2, . . . ei, . . . en, being of the same parallelepipedal shapes and having magnetic polarization parallel to one of its edges in a plane transversal to the axis ZZ', their direction of magnetization in the row changing alternately from one containing magnet ei to another next containing magnet ei+1, or preceding containing magnet ei−1, to create an alternating periodic magnetic field along the containment axis ZZ', wherein the magnetic structure of the containing device is unchanging for a rotation of 360°/p of said p rows about the axis ZZ'.

2. The microwave frequency structure as claimed in claim 1, wherein the containing device comprises a pair of rows of permanent magnets R1, R2 that are symmetrical relative to the axis ZZ', the magnetic polarizations of the containing permanent magnets in one and the same plane transversal to the axis ZZ' having directions of axis CC' passing through the axis ZZ', the magnetic structure of a row R1 being unchanging for the other row R2 in a rotation of 180° about the axis ZZ'.

3. The microwave frequency structure as claimed in claim 2, wherein the two rows R1, R2 of permanent magnets are separated by a space comprising two cooling channels either side of the axis ZZ', to dispel the calories released by the central portion of the microwave frequency structure toward a cold source.

4. The microwave frequency structure as claimed in claim 3, wherein the cooling channels are passages in two copper blocks in the space between the two rows R1, R2 of permanent magnets, either side of the axis ZZ'.

5. The microwave frequency structure as claimed in claim 2, wherein each containing magnet ei of a row R1, R2, . . . Rp is sandwiched, on an axis SS' perpendicular to the polarization axis CC' of the containing permanent magnet ei, between two secondary permanent magnets shi, sbi, of row i, of the same parallelepipedal shapes, the two secondary magnets having magnetic polarizations of the same axis SS' and of opposing polarization directions, the magnetization directions of two secondary magnets shi, sbi changing alternately from one containing magnet ei to another next containing magnet ei+1 or preceding containing magnet ei−1 of each row of permanent magnets.

6. The microwave frequency structure as claimed in claim 1, wherein the containing device comprises two pairs of rows of containing permanent magnets e1, e2, . . . ei, . . . en, a first pair comprising two rows R1, R2 and a second pair comprising two other rows R3, R4, the rows being symmetrical in pairs relative to the axis ZZ' and in two perpendicular planes passing through the axis ZZ', the magnetic polarizations of the permanent magnets, in one and the same transverse plane relative to the axis ZZ', having directions of axis CC' passing through the axis ZZ', the magnetic structure of one pair being unchanging for the other pair in a rotation of 90° about the axis ZZ'.

7. The microwave frequency structure as claimed in claim 6, wherein the containing permanent magnets ei of rank i, in one and the same transverse plane, are separated from the containing permanent magnets ei+1, of next rank i+1, or ei−1 of preceding rank i−1, by fins made of heat-conducting metal so as to evacuate the heat released into the cylindrical vacuum jacket toward cooling channels of the microwave frequency structure.

8. The microwave frequency structure as claimed in claim 6, wherein each containing magnet ei of a row R1, R2, . . . Rp is sandwiched, on an axis SS' perpendicular to the polarization axis CC' of the containing permanent magnet ei, between two secondary permanent magnets shi, sbi, of row i, of the same parallelepipedal shapes, the two secondary magnets having magnetic polarizations of the same axis SS' and of opposing polarization directions, the magnetization directions of two secondary magnets shi, sbi changing alternately from one containing magnet ei to another next containing magnet ei+1 or preceding containing magnet ei−1 of each row of permanent magnets.

9. The microwave frequency structure as claimed in claim 1, wherein each containing magnet ei of a row R1, R2, . . . Rp is sandwiched, on an axis SS' perpendicular to the polarization axis CC' of the containing permanent magnet ei, between two secondary permanent magnets shi, sbi, of row i, of the same parallelepipedal shapes, the two secondary magnets having magnetic polarizations of the same axis SS' and of opposing polarization directions, the magnetization directions of two secondary magnets shi, sbi changing alternately from one containing magnet ei to another next containing magnet ei+1 or preceding containing magnet ei−1 of each row of permanent magnets.

10. The microwave frequency structure as claimed in claim 9, wherein the containing permanent magnets ei of rank i, in one and the same transverse plane, are separated from the containing permanent magnets ei+1, of next rank i+1, or ei−1 of preceding rank i−1, by fins made of heat-conducting metal so as to evacuate the heat released into the cylindrical vacuum jacket toward cooling channels of the microwave frequency structure.

11. The microwave frequency structure as claimed in claim 9, wherein each row R1, R2, . . . Rp of containing permanent magnets e1, e2, . . . ei, . . . en, comprises a series of auxiliary magnets ax1, ax2, . . . axi, . . . axn−1, of the same parallelepipedal shapes, an auxiliary magnet axi of the series being inserted between two containing magnets ei, e+1, with a polarization axis AA' parallel to the axis ZZ', an auxiliary magnet axi between two containing magnets having a polarization of opposite direction to a next auxiliary magnet axi+1, or preceding auxiliary magnet axi−1, of the series of auxiliary magnets in each row.

12. The microwave frequency structure as claimed in claim 1, wherein the containing device comprises two pairs of adjacent rows of containing permanent magnets e1, e2, . . . ei, . . . en, about the axis ZZ', a first pair comprising two rows R1, R2 and a second pair comprising two other rows R3, R4, each containing permanent magnet of parallelepipedal shape having long sides and short sides perpendicular to the long sides, a long side of a containing magnet ei of one row being in contact by a short side of a magnet ei of another adjacent row so that the four magnets ei of the four adjacent rows R1, R2, R3, R4, in one and the same plane transversal to the axis ZZ', delimit a square centered on the axis ZZ', the magnetic polarizations of the containing permanent magnets ei, in one and the same transverse plane, having directions of axis DD' perpendicular to the long sides of the containing permanent magnet, the magnetic structure of the first pair of rows R1, R2 being unchanging by rotation of 180° about the axis ZZ', like the magnetic structure of the second pair of rows R3, R4, the first pair of rows R1, R2 being converted into the second pair of rows R3, R4 by a rotation of 90° about the axis ZZ".

13. The microwave frequency structure as claimed in claim 12, wherein the containing permanent magnets ei of rank i, in one and the same transverse plane, are separated from the containing permanent magnets ei+1, of next rank i+1, or ei−1 of preceding rank i−1, by fins made of heat-conducting metal so as to evacuate the heat released into the cylindrical vacuum jacket toward cooling channels of the microwave frequency structure.

14. The microwave frequency structure as claimed in claim 1, wherein each row R1, R2, . . . Rp of containing permanent magnets e1, e2, . . . ei , . . . en, comprises a series of auxiliary magnets ax1, ax2, . . . axi, . . . axn−1, of the same parallelepipedal shapes, an auxiliary magnet axi of the series being inserted between two containing magnets ei, e+1, with a polarization axis AA' parallel to the axis ZZ', an auxiliary magnet axi between two containing magnets having a polarization of opposite direction to a next auxiliary magnet axi+1, or preceding auxiliary magnet axi−1, of the series of auxiliary magnets in each row.

15. The microwave frequency structure as claimed in claim 14, wherein the auxiliary magnets ax1, ax2, . . . axi, . . . axn−1 comprise magnetic cores between the rows R1, R2, . . . Rp of containing permanent magnets, these cores being positioned, on the axis ZZ' and the axis YY', in the middle of the auxiliary magnets ax1, ax2, . . . axi, . . . axn−1 having a magnetization parallel to the axis ZZ' in order to produce a non-sinusoidal magnetic field, similar to that used for TWTs with coupled cavities.

16. The microwave frequency structure as claimed in claim 1, wherein the containing magnets e1, e2, . . . ei, . . . en, of transverse magnetization, comprise magnetic cores between the rows R1, R2, . . . Rp of containing permanent magnets, these cores being positioned, on the axes ZZ' and YY', in the middle of said containing magnets to increase the intensity of the magnetic field in the axis ZZ'.

17. The microwave frequency structure as claimed in claim 1, wherein the containing magnets e1, e2, . . . ei, . . . en, of transverse magnetization, comprise field correcting magnetic cores between the rows R1, R2, . . . Rp of containing permanent magnets, these field correcting cores being positioned, on the axis ZZ', level with the faces in contact between two adjacent containing magnets ei, ei+1 and, on the axis YY', in the middle of said containing magnets in order to produce a non-sinusoidal magnetic field.

18. A microwave frequency tube wherein it comprises a microwave frequency structure as claimed in claim 1.

19. A traveling wave tube (TWT) wherein it comprises a microwave frequency structure as claimed in claim 1.

* * * * *

UNITED STATES PATENT AND TRADEMARK OFFICE

CERTIFICATE OF CORRECTION

PATENT NO. : 8,427,057 B2
APPLICATION NO. : 12/747946
DATED : April 23, 2013
INVENTOR(S) : Durand et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 537 days.

Signed and Sealed this
Eighth Day of September, 2015

Michelle K. Lee

Michelle K. Lee
*Director of the United States Patent and Trademark Office*